US005533541A

United States Patent [19]

Cheng et al.

[11] Patent Number: 5,533,541

[45] Date of Patent: Jul. 9, 1996

[54] AUTOMATIC UMBRELLA WITH MULTIPLE OPERATION MODES

[76] Inventors: Jonathan Cheng, 5F., No. 10, Lane 169. Sec 1,Ta-an RD.; Luk Chou, No. 1, Alley 9, Lane 250. Sec 2, Cheng Gung RD., Nei Hu Area., both of Taipei, Taiwan

[21] Appl. No.: 442,096

[22] Filed: May 16, 1995

[51] Int. Cl.[6] ..... A45B 25/14

[52] U.S. Cl. ..... 135/22; 135/40; 135/20.3; 135/23; 135/24; 135/25.33

[58] Field of Search ..... 135/15.1, 19.5, 135/20.3, 22, 23, 24, 25.33, 28, 38, 39, 40

[56] References Cited

U.S. PATENT DOCUMENTS

| | | | |
|---|---|---|---|
| 3,687,146 | 8/1972 | Seitel | 135/24 X |
| 4,548,222 | 10/1985 | Day | 135/24 |
| 5,036,872 | 8/1991 | Huang | 135/40 X |
| 5,088,512 | 2/1992 | Chou et al. | 135/28 X |
| 5,144,969 | 9/1992 | Chou et al. | 135/39 X |
| 5,224,505 | 7/1993 | Wu | 135/39 X |
| 5,232,004 | 8/1993 | Wu | 135/38 X |
| 5,247,955 | 9/1993 | Wu | 135/40 X |
| 5,267,583 | 12/1993 | Wu | 135/23 X |
| 5,361,792 | 11/1994 | Lin et al. | 135/38 X |
| 5,390,686 | 2/1995 | Lin et al. | 135/24 |

FOREIGN PATENT DOCUMENTS

| | | | |
|---|---|---|---|
| 2240038 | 7/1991 | United Kingdom | 135/24 |

*Primary Examiner*—Wynn E. Wood
*Attorney, Agent, or Firm*—Bacon & Thomas

[57] ABSTRACT

An automatic umbrella including an inside cap at the top of the umbrella shaft thereof, a top runner mounted around the umbrella shaft, an open control spring mounted between the inside cap and the top runner and compressed to preserve energy for opening the umbrella when the umbrella is collapsed, a collapse control spring compressed and retained in the compressed position by means of the operation of the hook of a locating device on the top end of the bottom shaft of the umbrella shaft, and the operation of the detent of a release control device inside the umbrella shaft, to preserve energy for collapsing the umbrella when the umbrella is opened, and a control block with a push plate moved vertically to actuate the release control device in automatically opening/closing the umbrella, and a bottom runner having a hook hooked on the umbrella shaft for allowing the umbrella to be operated manually when the hook of the bottom runner is released.

4 Claims, 4 Drawing Sheets

AUTOMATIC UMBRELLA WITH MULTIPLE OPERATION MODES

BACKGROUND OF THE INVENTION

The present invention relates to umbrellas, and relates more particularly to an automatic umbrella which can be conveniently operated manually as well as automatically.

Various automatic umbrellas have been developed, and have appeared on the market. However, these automatic umbrellas are commonly complicated in structure and expensive to manufacture. When one buys an automatic umbrella, the auto-release control mechanism must be set into position by oneself before use, or the umbrella shall not be opened. Furthermore, these automatic umbrellas are not practical for a manual operation. If the auto-release control mechanism is damaged, the umbrella becomes useless.

SUMMARY OF THE INVENTION

The present invention has been accomplished to provide an automatic umbrella which eliminates the aforesaid drawbacks. According to the present invention, an open control spring is mounted between the inside cap and the top runner and compressed to preserve energy for opening the umbrella when the umbrella is collapsed; a collapse control spring is compressed and retained in the compressed position by means of the operation of the hook of a locating device on the top end of the bottom shaft of the umbrella shaft, and the operation of the detent of a release control device, to preserve energy for collapsing the umbrella when the umbrella is opened. By moving the push plate of a control block in the handle of the umbrella upwards or downwards, the release control device is operated to automatically open/close the umbrella. By releasing the hook on the bottom runner from the umbrella shaft, the umbrella can be operated manually.

DETAILED DESCRIPTION OF THE PREFERRED EMBODIMENT

Figure 1:
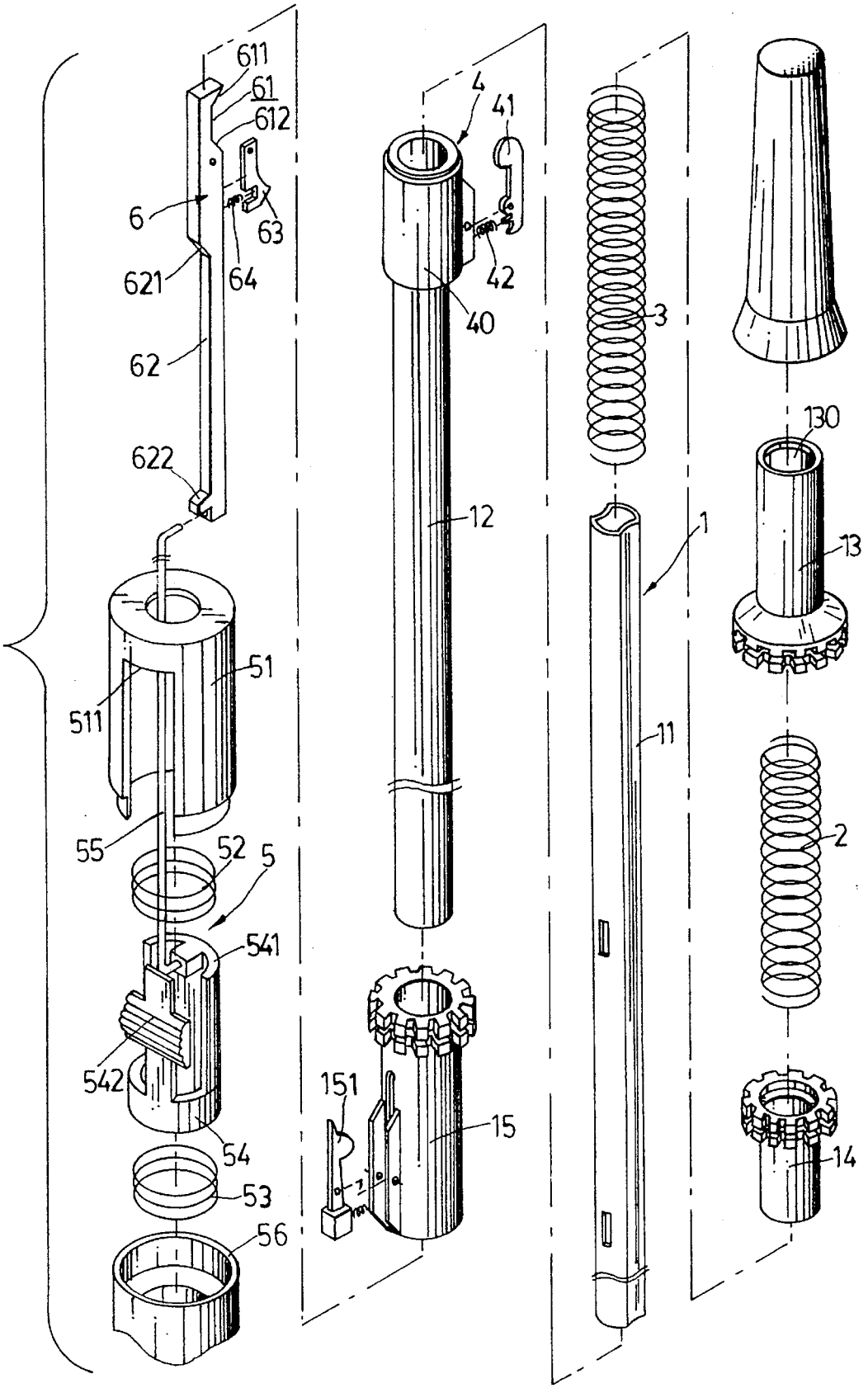
FIG. 1 an exploded view of the present invention.
Figure 2:
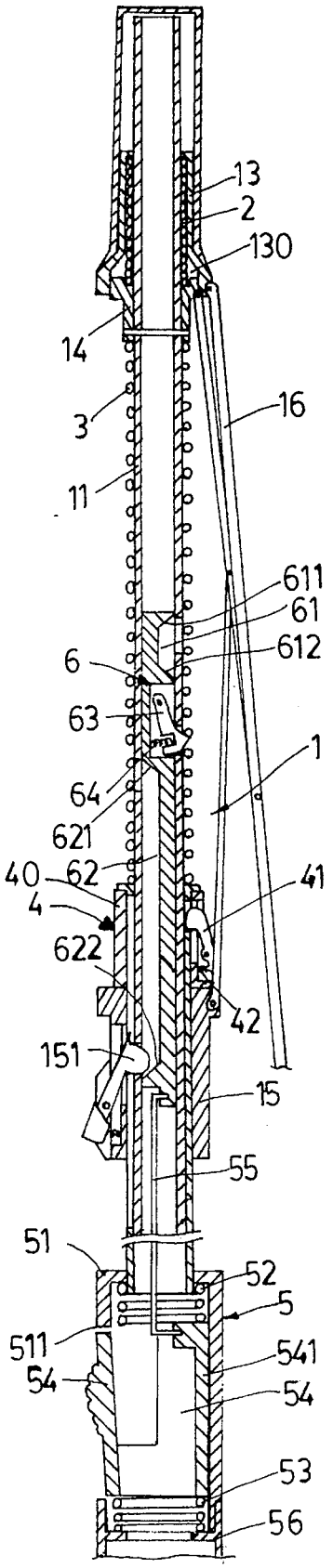
FIG. 2 is a longitudinal view in section of the present invention, showing the umbrella collapsed.

Referring to FIGS. 1 and 2, the present invention is generally comprised of a frame unit 1, an open control spring 2, a collapse control spring 3, a locating device 4, a handle & control device 5, and a release control device 6. The frame unit 1 comprises an umbrella shaft 10, which consists of an upper shaft 11 and a bottom shaft 12, an inside cap 13, a top runner 14, a bottom runner 15, and a rib and stretcher assembly 16. The inside cap 13 is mounted around the upper shaft 11 at the top, defining a longitudinal open chamber 130. The top runner 14 is mounted around the upper shaft 11 and moved between the inside cap 13 and the locating device 4. The open control spring 2 is mounted around the upper shaft 11, having a top end received in the longitudinal open chamber 130 and a bottom end stopped at the top runner 14. The collapse control spring 3 is mounted around the upper shaft 11 and stopped between the top runner 14 and the locating device 4. The locating device 4 comprises a base 40 shaped like a split ring and fixedly mounted around the top end of the bottom shaft 12 and stopped against the collapse control spring 3, a spring 42 connected to the base 40, a hook 41 pivoted to the base 40 and forced against the shaft 10 by the spring 42. The handle & control device 5 is fixed to the bottom end of the umbrella shaft 10, comprising a handle 56, a socket 51, and a control block 54 mounted within the socket 51 and supported between a first return spring 52 and a second return spring 54. The control block 54 comprises a base 541 and a unitary push plate 542. The push plate 542 is stopped outside a window 511, on the socket 51. The release control device 6 is mounted within the bottom shaft 12 corresponding to the locating device 4 and the bottom runner 15, and connected to the push plate 542 of the control block 54 of the handle & control device 5 by a wire rod 55. As illustrated the release control device 6 comprises a first control section 61, a second control section 62, and a detent 63. The first control section 61 comprises a top actuating surface 611 sloping outwardly upwards, and a bottom actuating surface 612 sloping outwardly downwards. The second control section 62 comprises a top actuating surface 621, sloping outwardly upwards, and a bottom actuating surface 622 sloping outwardly downwards. The pitch between the top actuating surface 621 and the bottom actuating surface 622 is determined subject to the sliding stroke of the bottom runner 15 between the upper limit in which the umbrella is opened, and the bottom limit in which the umbrella is closed. The detent 63 is pivoted to the release control device 6 and supported on a spring 64 between the first control section 61 and the second control section 62. The spring 64 forces the detent 63 outwards. When the umbrella is collapsed and the collapse control spring 3 is compressed, the detent 63 holds the upper shaft 11 and the bottom shaft 12 in the collapsed position. When the upper shaft 11 and the bottom shaft 12 are retained by the detent 83 in the collapsed position, the push plate 542 of the control block 54 is stopped outside the window 51.1 on the socket 51 to hold the release control device g in position.

Figure 3:
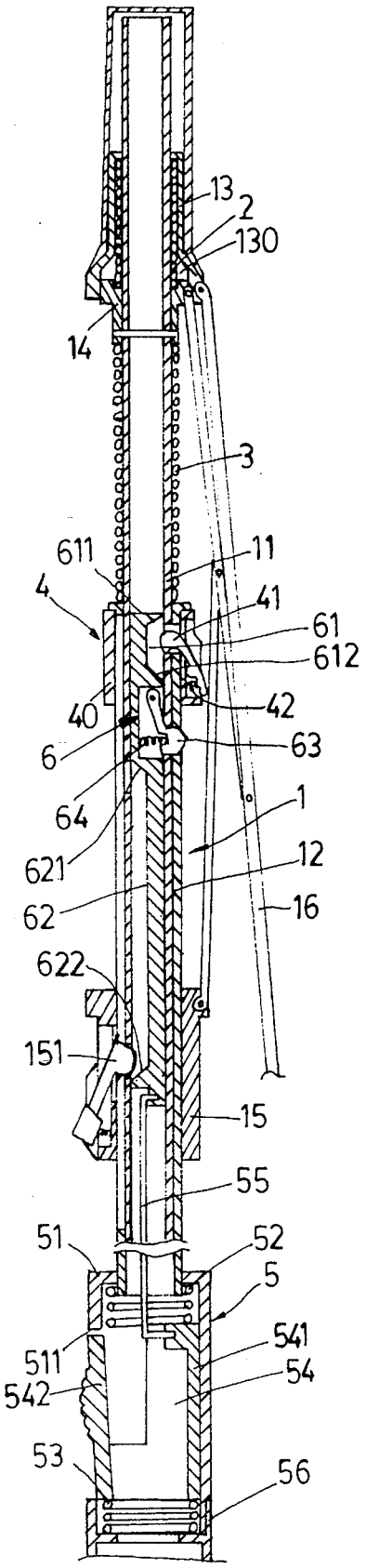
FIG. 3 is similar to FIG. 2 but showing the open control spring and the collapse control spring respectively compressed.
Figures 4, 5, 6:
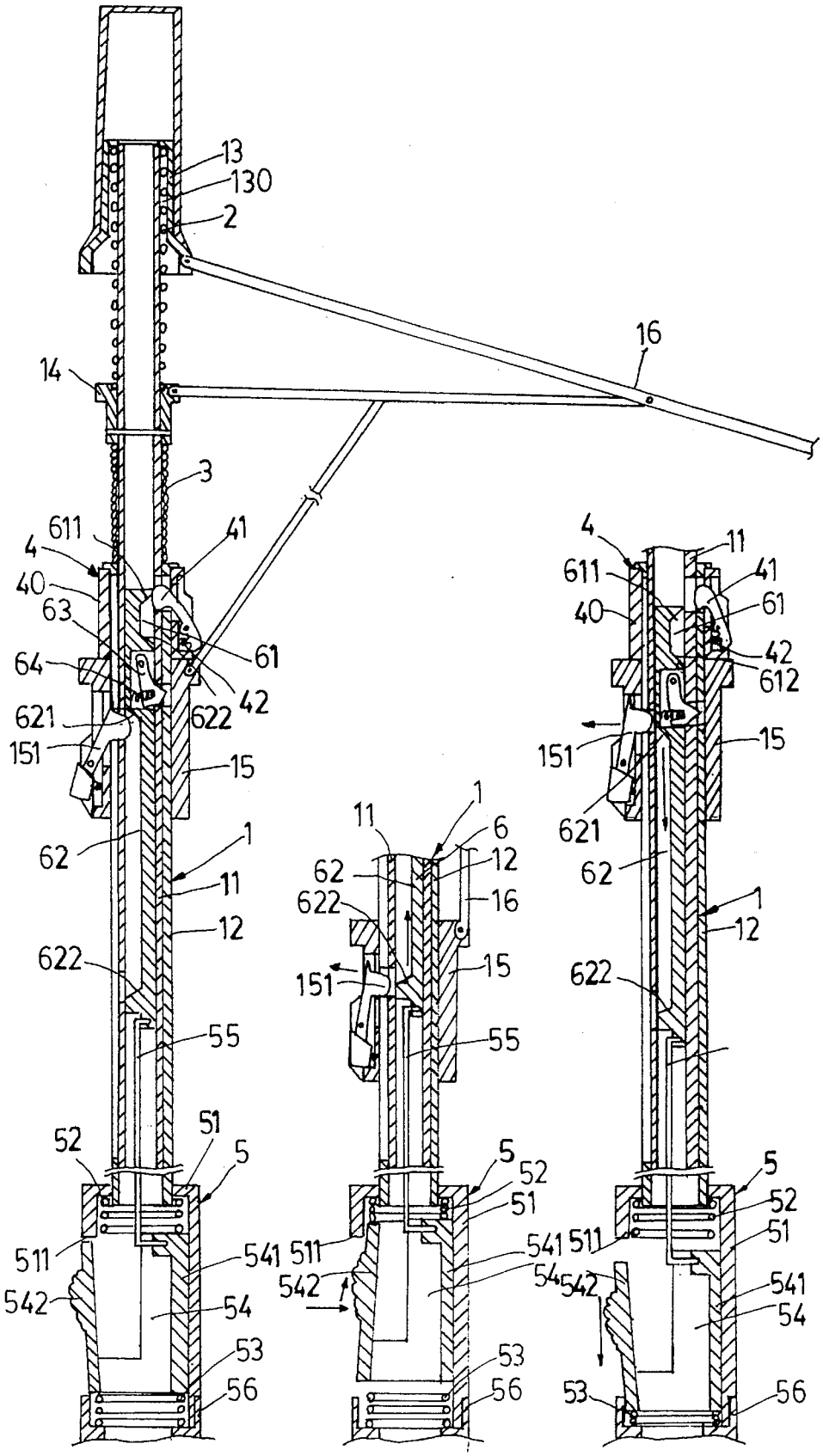
FIG. 4 shows the control block moved upwards and the hook of the bottom runner released from the top and bottom shafts according to the present invention.
FIG. 5 a sectional view showing the umbrella opened according to the present invention.
FIG. 6 shows the control block moved downwards and the hook of the bottom runner released from the top and bottom shafts according to the present invention.
Figure 9:
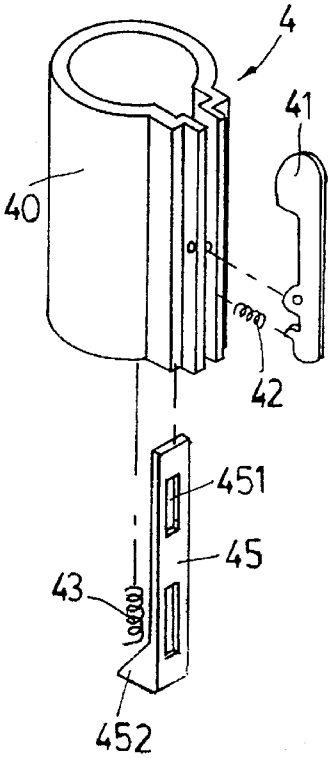
FIG. 9 shows another alternate arrangement of the locating device according to the present invention.
Figure 11:
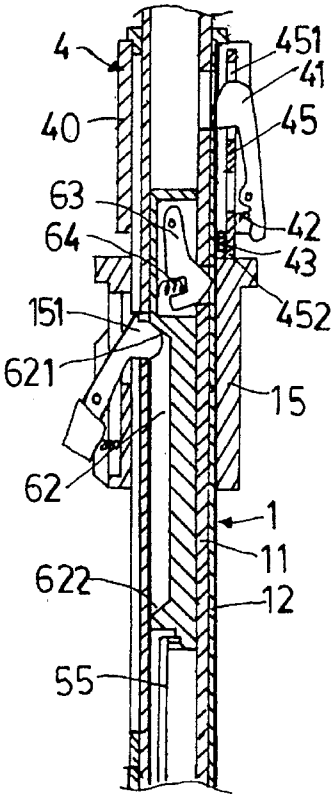
FIG. 11 is similar to FIG. 10 but showing the bottom runner moved to the upper limit.
Figure 10:
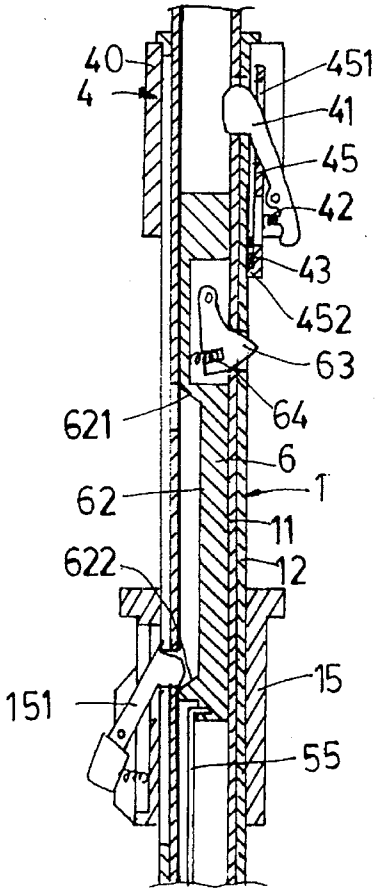
FIG. 10 is a sectional view showing the locating device of FIG. 9 installed.

When the aforesaid parts are assembled and the rib and stretcher assembly 16 is collapsed as shown in FIG. 2. The open control spring 2 is axially compressed between the inside cap 13 and the top runner 14, and the hook 151, of the bottom runner 15 is hooked on the umbrella shaft 10 in the collapsed position. Then, a pressure is given to the bottom shaft 12 through the handle & control device 5 to force the bottom shaft 12 toward the top runner 14 in compressing the collapse control spring 3, causing the hook 41 of the locating device 4 to hook on the umbrella shaft 10 (see FIG. 3). At this moment, the open control spring 2 and the collapse control spring 3 are respectively compressed, and the detent 63 of the release control device 6 holds the upper shaft 11 and the bottom shaft 12 in position. Under this condition, the user can open the umbrella manually or automatically. When the user selects the manual mode, the hook 151 of the bottom rubber 15 is released from the umbrella shaft 10 by hand, permitting the open control spring 2 to stretch open the umbrella, and at the same time the bottom runner 15 is moved to the upper limit and retained in position by the hook 151. At this stage, the locating device 4 is not released, and therefore the collapse control spring 3 is still retained in the compressed position. However, the detent 63 is released from the bottom runner 15. When the user selects the automatic mode, the push plate 542 is depressed and released from the constraint of the window 511 and then pushed upwards to displace the release & control device 6, causing the bottom actuating surface 622 of the release & control device 6 to release the hook 151, of the bottom runner 15 from the umbrella shaft 10 (see FIG. 4), therefore the open control spring 2 is released to stretch open the umbrella, and at the same time the bottom runner 15 is moved to the lower limit and retained in position by the hook 151 and the detent 63 is simultaneously released (see FIG. 5). Because the first control section 61 of the release control device 6 does not drive the locating device 4, the collapse control spring 3 is steel retained in the compressed position. When to collapse the umbrella, the push plate 542 of the control block 54 is moved downwards to pull down the release control device 6 through the wire rod 55, causing the top actuating surface 611 of the first control section 61 and the top actuating surface 621 of the second control section 62 to synchronously release the hook 41 of the locating device 4 and the hook 151 of the bottom runner 15 (see FIG. 6), and therefore the collapse control spring 3 is released to force the upper shaft 11 and the bottom runner 15 downwards to open the umbrella. Therefore, the umbrella can be operated either manually or automatically. Even if the automatic mode is out of order, the umbrella can still be operated normally through the manual mode.

Figure 8:
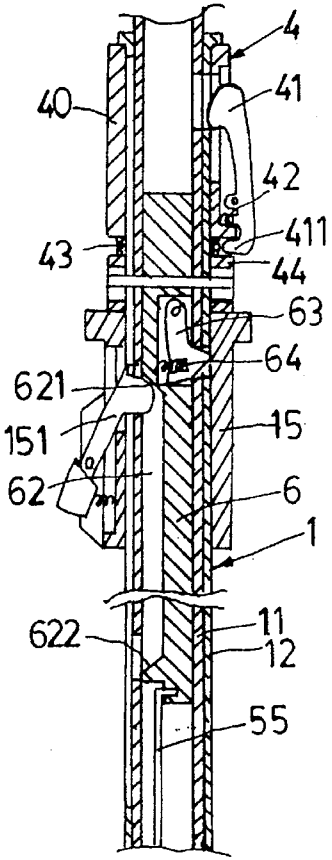
FIG. 8 similar to FIG. 7 but showing the bottom runner moved to the upper limit.
Figure 7:
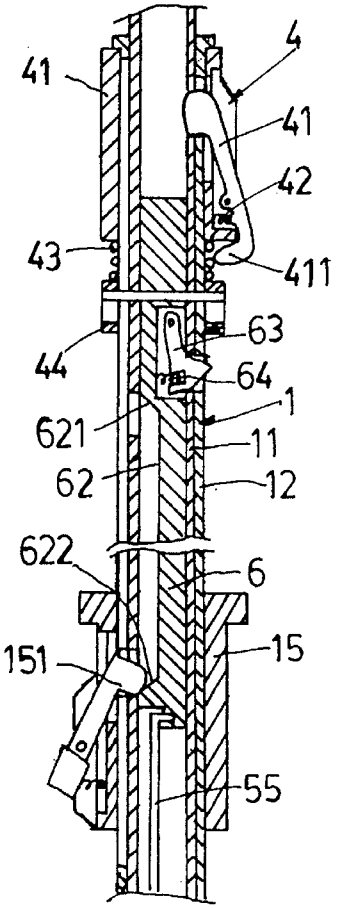
FIG. 7 shows an alternate arrangement of the locating device according to the present invention.

Referring to FIGS. 7 and 8, a spring 43 is fastened to the umbrella shaft 10 to hold a slide 44 below the split ring-like base 40. The hook 41 of the locating device 4 has a projecting tip 411 at the bottom end disposed between the base 40 and the slide 44. When the umbrella is collapsed, the hook 41 hooks on the umbrella shaft 10 to hold the umbrella in the collapsed position. When the umbrella is opened, the bottom runner 15 is moved upwards to force the slide 44 toward the base 40, causing the tip 411 moved to release the hook 41 from the umbrella shaft 10.

Figures from 9 to 11 show another alternate form of the locating device 4. As illustrated, the longitudinal sliding plate, referenced by 45, is connected to the spring 43 and moved in the split ring-like base 40, having a push end 452 disposed outside the base 40 and a hole 451 near the top end coupled to the hook 41. When bottom runner 15 is moved to the upper limit, it pushes the push end 452 of the longitudinal slide 45, causing the periphery of the hole 451 to force the hook 41 outwards, so that the umbrella can be further collapsed by moving the bottom runner 15 downwards.

We claim:

1. An umbrella operable either automatically or manually comprising:

a frame unit, said frame unit comprising an umbrella shaft, which consists of an upper shaft and a bottom shaft telescopically movable in and out of said upper shaft, an inside cap, a top runner, a bottom runner, an open control spring, a collapse control spring, and a rib and stretcher assembly, wherein said inside cap is mounted around a top end of said upper shaft and defining a longitudinal open chamber, said top runner is movably mounted around said upper shaft so as to move axially along said upper shaft between said inside cap and said bottom shaft, said open control spring is mounted around said upper shaft, said open control spring having a top end received in the longitudinal open chamber and a bottom end stopped against said top runner, said collapse control spring mounted around said upper shaft and extending between said top runner and said bottom shaft, a locating device fixedly secured to said bottom shaft at a top end thereof, comprising a split ring base fixedly mounted around the top end of said bottom shaft and stopped against said collapse control spring, a spring-biased hook pivoted to said base and urged against said umbrella shaft by the spring bias;

a handle and control device fastened to said umbrella shaft at a bottom end thereof, said handle and control device comprising a handle, a socket, and a control block mounted within said socket and supported between a first return spring and a second return spring, said control block comprising a base and a unitary push plate, said push plate being stopped outside a window on said socket; and a release control device mounted within said bottom shaft and connected to said control block of said handle and control device by a wire rod and driven by said push plate, said release control device comprising a first control section, a second control section, and a detent, said first control section comprising a first top actuating surface sloping outwardly upwards and a first bottom actuating surface sloping outwardly downwards, said second control section comprising a second top actuating surface sloping outwardly upwards and a second bottom actuating surface sloping outwardly downwards, said detent being pivoted to said release control device between said first control section and said second control section;

wherein said open control spring is compressed to preserve energy for opening the umbrella when the umbrella is collapsed, said collapse control spring is compressed and retained in the compressed position by means of the hook of said locating device and the operation of the detent of said release control device to preserve energy for collapsing the umbrella when the umbrella is opened, whereby, by moving the push plate of said control block upwards or downwards, said release control device automatically opens or closes the umbrella and by moving said bottom runner along the umbrella shaft, the umbrella can be operated manually.

2. The umbrella of claim 1 wherein the pitch between the second top actuating surface and the second bottom actuating surface of said second control section determines the sliding stroke of said bottom runner between an upper limit in which the umbrella is opened, and a bottom limit in which the umbrella is closed.

3. The umbrella of claim 1 further comprising a spring fastened to said umbrella shaft to bias a slide below said split ring base of said locating device, a hook on said locating device having a projecting tip at a bottom end thereof disposed between said split ring base and said slide, whereby said slide is forced toward said split ring base by said bottom runner when the umbrella is collapsed, causing the projecting tip of the hook to release said locating device from said umbrella shaft.

4. The umbrella of claim 1 further comprising a spring fastened to said umbrella shaft to hold a longitudinal sliding plate in said split ring base, said longitudinal sliding plate having a push end disposed outside said split ring base and a hole through which extends a hook of said locating device, the hook of said locating device being urged outwards by movement of said longitudinal sliding plate to release said umbrella shaft for permitting the umbrella to be collapsed when said bottom runner is moved upwards to push said end of said longitudinal slide.

* * * * *